United States Patent [19]

Takei et al.

[11] Patent Number: 4,493,620

[45] Date of Patent: Jan. 15, 1985

[54] ELECTRICALLY OPERATED FUEL PUMP DEVICE

[75] Inventors: Toshihiro Takei, Kariya; Kazuma Matsui, Toyohashi; Yoshiyuki Hattori, Toyoake; Kiyohiko Watanabe, Kariya; Toshiaki Nakamura, Anjo; Shunsaku Ohnishi, Toyota, all of Japan

[73] Assignee: Nippondenso Co., Ltd., Kariya, Japan

[21] Appl. No.: 358,785

[22] Filed: Mar. 16, 1982

[30] Foreign Application Priority Data

Mar. 20, 1981 [JP] Japan ..... 56-41096

[51] Int. Cl.[3] ..... F04B 35/04; F04D 5/00

[52] U.S. Cl. ..... 417/366; 417/423 R; 415/53 T; 415/213 T

[58] Field of Search ..... 417/410, 357, 423 R, 417/366; 415/53 T, 213 T, 198.2

[56] References Cited

U.S. PATENT DOCUMENTS

| | | | |
|---|---|---|---|
| 1,640,591 | 8/1927 | Borneman | 415/213 T |
| 1,865,396 | 6/1932 | Claypool | 415/213 T |
| 3,119,343 | 1/1964 | White | 417/423 R |
| 3,259,072 | 7/1966 | Carpenter | 415/213 T |
| 3,418,991 | 12/1968 | Shultz et al. | 417/423 R |
| 3,871,797 | 3/1975 | Igarashi et al. | 417/423 R |
| 4,006,998 | 2/1977 | Schonwald | 415/213 T |

FOREIGN PATENT DOCUMENTS

| | | | |
|---|---|---|---|
| 17941 | 8/1972 | Japan | 415/213 T |
| 17942 | 8/1972 | Japan | 415/213 T |

OTHER PUBLICATIONS

Carter, Karassik and Wright, *Pump Questions and Answers*, First Edition, McGraw Hill Book Co., Inc. 1949, pp. 187–195.

*Primary Examiner*—William L. Freeh
*Assistant Examiner*—Paul F. Neils
*Attorney, Agent, or Firm*—Cushman, Darby & Cushman

[57] ABSTRACT

An electrically operated fuel pump device for use in vehicles comprises a regenerative pump component and an electric motor component operatively connected to the regenerative pump component to actuate the same. The regenerative pump component includes a casing defining therein a pump chamber and a closed vane type impeller rotatably disposed within the pump chamber. The impeller has an outer peripheral portion thereof cooperating with the pump chamber to define a pump flow passage. The impeller has in the outer peripheral portion a plurality of circumferentially spaced vane grooves formed in opposite end faces of the impeller. The impeller has its outer diameter within a range of approximately 20–65 mm. A flow passage representative dimension defined by S/l is within a range of approximately 0.4–2 mm where S is a cross-sectional area of the pump flow passage and l is a cross-sectional peripheral length of the outer peripheral portion of the impeller.

6 Claims, 6 Drawing Figures

ELECTRICALLY OPERATED FUEL PUMP DEVICE

BACKGROUND OF THE INVENTION

1. Field of the Invention

The present invention relates to an electrically operated fuel pump device mounted on vehicles for forcedly delivering liquid fuel from a fuel reservoir to a fuel consumption installation at high pressure and at low flow rate.

2. Description of the Prior Art

An electrically operated fuel pump device used to forcedly deliver liquid fuel within a fuel tank to an engine of vehicles, for example, is required to supply the fuel at a relatively high discharge pressure of 2–3 $Kg/cm^2$ and at a relatively low discharge flow rate of 40–150 l/hr. Therefore, most of such fuel pump devices utilize a positive displacement pump. There are also fuel pump devices using a centrifugal pump. However, the use of such fuel pump devices is limited to a case where the fuel is delivered at a relatively low discharge pressure below 1 $Kg/cm^2$.

The fuel pump device which utilizes the positive displacement pump has such disadvantages that the manufacturing cost is high, because a desired performance is not obtained as far as the manufacturing accuracy or tolerance is not increased, and that vibration and noise are increased because of high fluctuation in discharge pressure. In addition, the fuel pump device utilizing the centrifugal pump can obtain low pressure and high flow rate, but is difficult to obtain high pressure and low flow rate.

The inventors of the present application have directed their attention to the use of a closed vane type regenerative pump or WESTCO pump as a pump for the fuel pump device. It is possible for the regenerative pump to obtain a discharge pressure of order of 2–3 $Kg/cm^2$. However, if the regenerative pump is designed by the introduction of the generally used design factors or requirements of conventional regenerative pumps as they are, sufficient high discharge pressure is obtained, but discharge flow rate is increased more than is necessary. Accordingly, it is inappropriate to apply the generally used design factors or requirements to a regenerative pump of the fuel pump device for vehicles. The forced reduction of the discharge flow rate to a required level causes the pump efficiency to be considerably decreased. An electric motor for actuating the pump is required to have large capacity to increase the motor output so that the entire fuel pump device is large-sized and the consumed electric power is increased.

SUMMARY OF THE INVENTION

An object of the present invention is to provide an electrically operated fuel pump device for vehicles which forcedly delivers fuel at high pressure and at low flow rate, and which is reduced in weight, size, consumed electric power and manufacturing cost.

According to the present invention, there is provided an electrically operated fuel pump device for vehicles, comprising a regenerative pump component and an electric motor component operatively connected to the regenerative pump component to actuate the same, the regenerative pump component comprising: a pump casing defining therein a pump chamber; a closed vane type impeller operatively connected to the electric motor component and rotatable within the pump chamber, the impeller having an outer peripheral portion thereof cooperating with the pump chamber to define a pump flow passage, the impeller having in the outer peripheral portion a plurality of vane grooves formed in opposite axial end faces of the impeller in circumferentially spaced relation to each other; and the impeller having its outer diameter within a range of approximately 20–65 mm, and a flow passage representative dimension defined by S/l being within a range of approximately 0.4–2 mm, where S is a cross-sectional area of the pump flow passage and l is a cross-sectional peripheral length of the outer peripheral portion.

DETAILED DESCRIPTION OF THE PREFERRED EMBODIMENT

Figure 1:
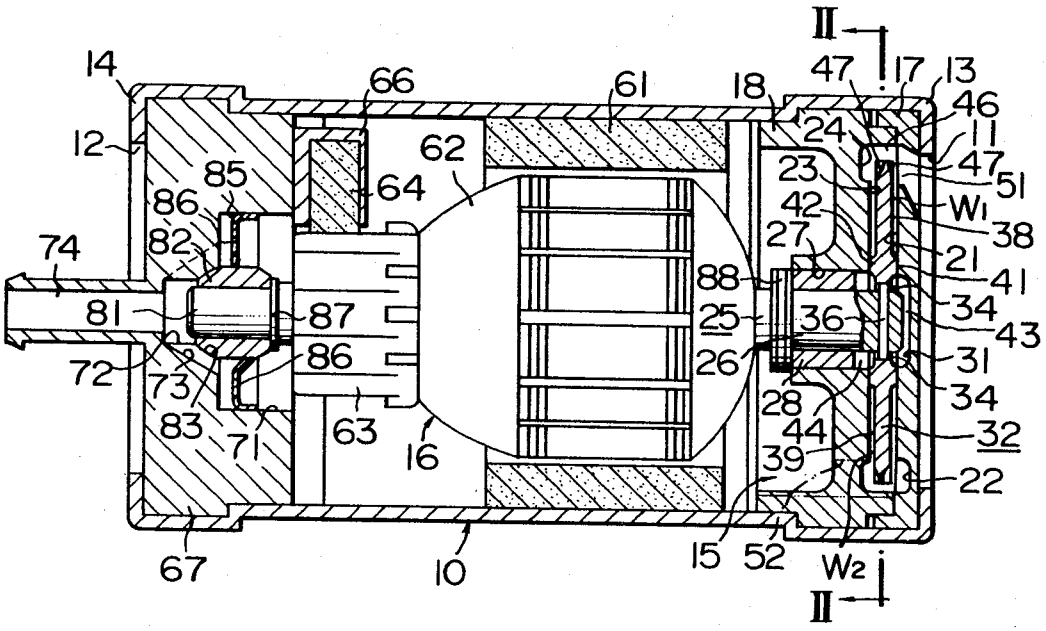
FIG. 1 is a longitudinal cross-sectional view of an electrically operated fuel pump device in accordance with an embodiment of the present invention and is a cross-sectional view taken along the line I—I of FIG. 2.

Referring to FIG. 1, there is shown in longitudinal cross-section an electrically operated fuel pump device for vehicles in accordance with an embodiment of the present invention. The fuel pump device is adapted to be immersed in liquid fuel within a fuel tank of the vehicle, for example. The fuel pump device comprises a generally cylindrical housing 10 including one and the other axial end walls 13 and 14 thereof which have formed therein openings 11 and 12, respectively. The fuel pump device further comprises a regenerative pump component 15 disposed within the housing 10 adjacent to the one axial end wall 11 and an electric motor component 16 disposed within the housing 10 adjacent to the regenerative pump component. The motor component 16 is operatively connected to the regenerative pump component 15 to actuate the same.

The regenerative pump component 15 includes a pump casing which comprises a first casing section 17 substantially closing the opening 11 in the one axial end wall 13 of the housing 10 and a second casing section 18 cooperating with the first casing section 17 to define a pump chamber therebetween. More particularly, the first casing section 17 has an inner surface 21 thereof opposite to the second casing section 18 and an arcuate recess 22 formed in the inner surface 21. The second casing section 18 has a circular recess 23 formed in an inner surface thereof opposite to the first casing section 17 and an arcuate recess 24 formed in a radially outer peripheral portion of the bottom surface of the circular recess 23. The pump chamber is defined by the inner surface 21 of the first casing section 17, the arcuate recess 22 in the first casing section, the circular recess 23 in the second casing section 18 and the arcuate recess 24 in the second casing section.

A shaft 25 has its axis extending in concentric relation to the arcuate recesses 22 and 24. The shaft 25 has one axial end portion 26 thereof which is rotatably supported in a central axial bore 27 formed in the second casing section 18 through a bearing 28. The one axial end portion 26 of the shaft 25 extends through the pump chamber and has an end face located within a central recess 31 formed in the inner surface 21 of the first casing section 17.

A generally disc-like impeller 32 is mounted on the shaft 25 for rotation within the pump chamber. The impeller 32 has a central axial bore 33 (FIG. 2) into which the one axial end portion 26 of the shaft 25 is fitted. A pair of axial grooves 34 are formed in the wall surface of the central bore 33 in diametrically opposed relation to each other. A pin 36 having a circular cross-section extends diametrically through the one axial end portion 26 of the shaft 25 and has opposite end portions fitted in the pair of axial grooves 34, respectively. Thus, the impeller 32 is mounted on the shaft 25 for axial movement therealong, but against rotation relative to the shaft. The impeller 32 has one axial end face 38 thereof spaced from the inner surface 21 of the first casing section 17 by a slight clearance $W_1$ and the other axial end face 39 spaced from the bottom surface of the circular recess 23 in the second casing section 18 by a slight clearance $W_2$. These clearances $W_1$ and $W_2$ are in fact extremely small in size, but are exaggeratedly shown in FIG. 1. Annular projections 41 and 42 are integrally formed on the one and the other axial end faces 38 and 39 of the impeller, respectively and have a height smaller than the clearances $W_1$ and $W_2$.

Figure 2:
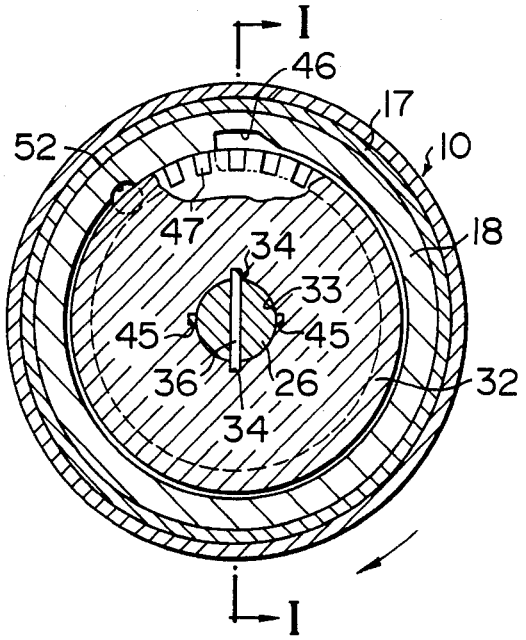
FIG. 2 is a cross-sectional view taken along the line II—II of FIG. 1.

The annular projection 41 cooperates with the recess 31 in the first casing section 17 and the outer peripheral surface and end face of the one axial end portion 26 of the shaft 25 to define a chamber 43. The annular projection 42 cooperates with the central axial bore 27 in the second casing section 18, an axial end face of the bearing 28 and the outer peripheral surface of the one axial end portion 26 of the shaft 25 to define a chamber 44. As best shown in FIG. 2, a second pair of diametrically opposed axial grooves 45 are formed in the wall surface of the central axial bore 33 in the impeller 32 to communicate the chambers 43 and 44 with each other, thereby to cause the fluid pressures within the chambers 43 and 44 to be balanced with each other.

The impeller 32 has an outer peripheral portion thereof which cooperates with the pump chamber defined in the pump casing 17, 18 to define an arcuate pump flow passage 46. The outer peripheral portion of the impeller has a plurality of vane grooves 47 formed in the one and the other axial end faces 38 and 39 of the impeller in circumferentially equi-distantly spaced relation to each other. The impeller 32 illustrated in the drawings is a so called "closed vane type impeller" in which the bottom surface of each vane groove 47 formed in the one axial end face 38 is not intersected with the bottom surface of each vane groove 47 formed in the other axial end face 39.

The pump flow passage 46 is communicated with liquid fuel within a fuel reservoir, not shown, through a suction port 51 formed in the first casing section 17 and is communicated with a space within the housing 10 through a discharge port 52 formed in the second casing section 18. The discharge port 52 does not in fact appear in FIG. 1 which is a cross-sectional view taken along the line I—I of FIG. 2, but is shown in FIG. 1 by a phantom line for convenience.

The electric motor component 16 comprises a pair of generally semi-cylindrical permanent magnets 61 disposed within the housing 10 in concentric relation to the shaft 25, an armature 62 fixedly mounted on the shaft 25 in concentric relation to the permanent magnet 61, and a commutator 63 fixedly mounted on the shaft 25 and connected to the armature 62. A brush 64 is in sliding contact with the commutator 63 and is held by a brush holder 66 secured to an end block 67 which is disposed within the housing 10 so as to substantially close the opening 12 in the other axial end wall 14 of the housing. The end block 67 has a central recess 71 formed in one axial end face of the end block exposed to the space within the housing 10 and a second central recess 72 formed in the bottom surface of the central recess 71. A plurality of grooves 73 are formed in the side wall surface of the second recess 72 in circumferentially spaced relation to each other. Each of the grooves 73 has its inclined bottom surface and an end opening to the bottom surface of the central recess 71. The end block 67 has formed integrally therewith a hollow projection 74 extending outwardly from the other axial end face of the end block. The projection 74 has therein a hollow portion which communicates with the second recess 72 and is adapted to be connected to a fuel consumption installation, not shown, such as an engine, for example.

The shaft 25 has the other axial end portion 81 which is rotatably supported by a bearing 82 seated on a seat 83 formed by chamfering the edge of the second recess 72. The bearing 82 is held in position by an annular retainer 85 disposed within the central recess 71. The retainer 85 has formed therein a plurality of circumferentially spaced bores 86. The shaft 25 is held in radial position by the retainer 85 and is held in axial position by a spacer 87 mounted on the shaft 25 in contact with an axial end face of the bearing 82 and a spacer 88 mounted on the shaft 25 in contact with an axial end face of the bearing 28.

In operation, electric current from an electric power source, not shown, is applied to the commutator 63 through the brush 64 to rotate the armature 62. The rotation of the armature 62 is transmitted to the impeller 32 through the shaft 25 to cause the impeller to be rotated in the clockwise direction as shown by an arrow in FIG. 2. The rotation of the impeller 32 causes the liquid fuel within the fuel reservoir to be delivered into the pump flow passage 46 through the suction port 51. The fuel is increased in pressure within the pump flow passage 46 by the action of the vane grooves 47, and is discharged into the space within the housing 10 through the discharge port 52. The fuel flows through an annular gap between the permanent magnet 61 and the armature 62, the bores 86 in the retainer 85 and the grooves 73 in the end block 67, and is supplied to the fuel consumption installation through the hollow portion of the hollow projection 74.

Figure 3:
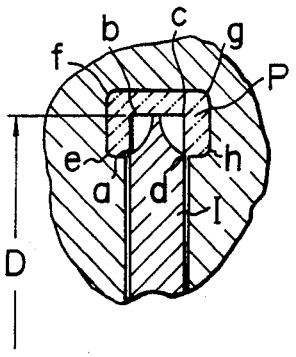
FIG. 3 is a fragmental cross-sectional view of a regenerative pump component for the explanation of a flow passage representative dimension.
Figure 4:
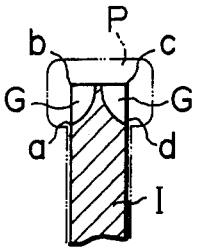
FIG. 4 is a fragmental cross-sectional view of an impeller for the explanation of the flow passage representative dimension.

In general, an electrically operated fuel pump device for use in a fuel injection system for supplying liquid fuel from a fuel tank to an engine of a vehicle forcedly delivers the fuel at discharge pressure of 2–3 $Kg/cm^2$ and at discharge flow rate of 40–150 l/hr. If a regenerative pump in such fuel pump device is designed by utilizing the design factors or requirements conventionally recommended in literatures or the like as they are, the regenerative pump is decreased in efficiency, and is uneconomical because of excessive increase in discharge flow rate so that the regenerative pump becomes unsuitable for use in a fuel pump device of a fuel injection system for vehicle. For example, in a conventional regenerative pump, 90–200 mm is recommended for an outer diameter (D) of an impeller (I) shown in FIG. 3, and 2.4–13.4 mm is recommended for a flow passage representative dimension (Rm) defined by S/l where S is a cross-sectional area of a pump flow passage (P) surrounded by points a, b, c, d, h, g, f, e and a and shaded by phantom lines in FIG. 3, and l is a cross-sectional peripheral length of a vane groove (G) indicated by lines $\overline{ab}+\overline{bc}+\overline{cd}$ in FIG. 4, i.e., a cross-sectional peripheral length of an outer peripheral portion of the impeller (I) having formed therein the vane groove (G).

However, in case where the outer diameter of the impeller is 90–200 mm, the entire fuel pump device is large-sized and it is particularly impossible to apply such fuel pump device to a fuel injection system for vehicle. From this, it will be appreciated that it is impossible to design a regenerative pump component for a small-size fuel pump device by using the design factors or requirements conventionally recommended in general literatures as they are.

Figure 5:
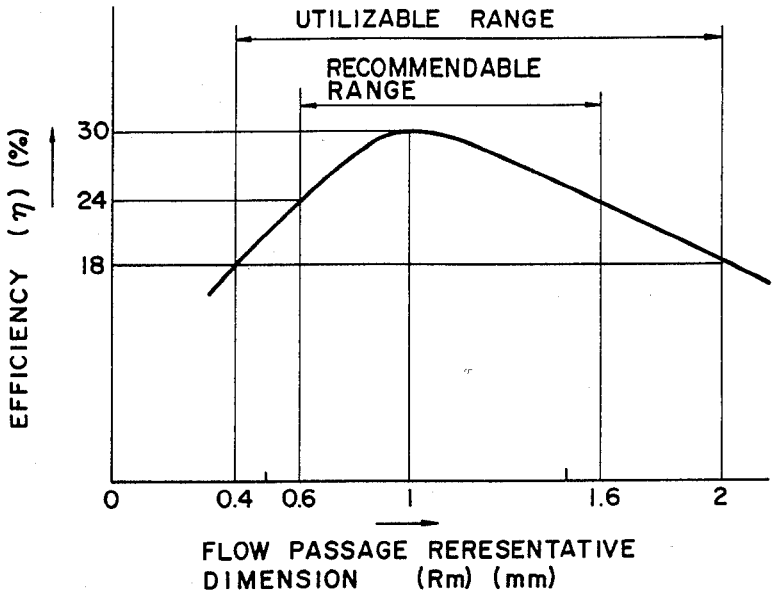
FIG. 5 is a graph showing a relation between an efficiency and the flow passage representative dimension obtained by experiments.
Figure 6:
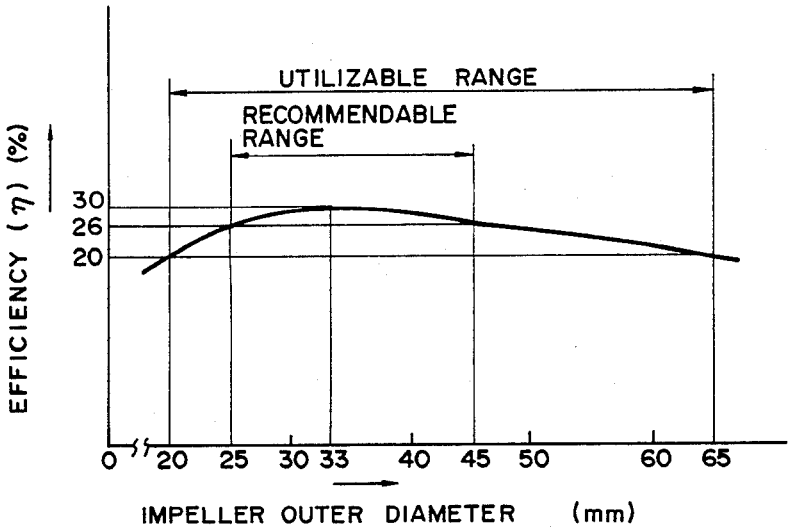
FIG. 6 is a graph illustrating a relation between the efficiency and an outer diameter of the impeller obtained by experiments.

The inventors of the present application has conducted several experiments to seek for optimum design factors and dimensions of a regenerative pump component having a closed vane type impeller particularly suitable for use in a fuel injection system for vehicles, in which the impeller has its outer diameter of less than 90 mm and high discharge pressure is obtained. The experimental results are shown in FIGS. 5 and 6. FIG. 5 shows a relation between the flow passage representative dimension (Rm) and the efficiency ($\eta$) at the discharge pressure of 2 Kg/cm$^2$ and at the discharge flow rate of 80–120 l/hr. As will be clearly seen from FIG. 5, the efficiency is maximized when the value of Rm is approximately 1 mm. The economically acceptable minimum efficiency ($\eta$) is approximately 18% and in consideration of the relation to the motor, the utilizable value of Rm is within a range of approximately 0.4–2 mm. The value of Rm within a range of approximately 0.6–1.6 mm is particularly preferable, because the efficiency of more than 24% is obtained. FIG. 6 shows a relation between the outer diameter of the impeller and the efficiency ($\eta$). As will be clearly seen from FIG. 6, the efficiency is maximized when the outer diameter of the impeller is approximately 33 mm. In consideration of both of the economically acceptable efficiency (approximately 18% as noted above) and the difficulty in attachment and manufacturing, the utilizable outer diameter of the impeller may be within a range of approximately 20–65 mm and a range of approximately 25–45 mm is particularly preferable, because the efficiency is satisfactory and the manufacturing is easy within such range.

As described above, the electrically operated fuel pump device in accordance with the present invention is arranged such that the outer diameter of the closed vane type impeller is within the range of 20–65 mm and the flow passage representative dimension is within the range of approximately 0.4–2 mm. Thus, the required efficiency is secured or ensured, and the fuel pump device is reduced in weight, size, consumed electric power and manufacturing cost. In addition, there is also provided an appropriate interrelation between the discharge pressure and the discharge flow rate for the electrically operated fuel pump device for vehicles.

What we claim is:

1. An electrically operated fuel pump device for vehicles, comprising a regenerative pump component and an electric motor component operatively connected to said regenerative pump component to actuate the same to discharge fuel at a pressure of at least 2 Kg/cm$^2$ and a flow rate of at least 40–150 l/hr, said regenerative pump component comprising:

a pump casing defining therein a pump chamber;

a closed vane type impeller operatively connected to said electric motor component and rotatable within said pump chamber, said impeller having an outer peripheral portion thereof cooperating with said pump chamber to define a pump flow passage, said impeller having in said outer peripheral portion a plurality of vane grooves formed in opposite axial end faces of said impeller in circumferentially spaced relation to each other; and said impeller having its outer diameter within a range of approximately 20–65 mm, and a flow passage representative dimension defined by S/l being within a range of approximately 0.4–2 mm where S is a cross-sectional area of said pump flow passage and l is a cross-sectional peripheral length of said outer peripheral portion.

2. A fuel pump device defined in claim 1, wherein said flow passage representative dimension is within a range of approximately 0.6–1.6 mm.

3. A fuel pump device defined in claim 1 or 2, wherein the outer diameter of said impeller is within a range of approximately 25–45 mm.

4. A fuel pump device defined in claim 1 or 2, wherein said impeller has first and second annular projections formed on said opposite axial and faces of said impeller, respectively, in concentric relation to the rotating axis of said impeller, said pump casing having end walls opposite to said axial end faces of said impeller, respectively, said first and second annular projections cooperating with said end walls of said pump casing to define first and second chambers, respectively, said regenerative pump component further including means for communicating said first and second chambers with each other to balance the fluid pressures within said first and second chambers with each other.

5. A fuel pump device defined in claim 4, wherein said regenerative pump component further includes a shaft connected to said electric motor component, said impeller being mounted on said shaft, said impeller having therein a central axial bore into which said shaft is fitted, said communicating means comprising at least one axial groove formed in a wall surface of said bore in said impeller.

6. A fuel pump device defined in claim 5, wherein said impeller is mounted on said shaft for axial movement therealong, but against rotation relative to said shaft.

* * * * *